US010465890B1

(12) United States Patent
Liu et al.

(10) Patent No.: US 10,465,890 B1
(45) Date of Patent: Nov. 5, 2019

(54) LED LAMP

(71) Applicant: Xiaojun Liu, Shenzhen (CN)

(72) Inventors: Xiaojun Liu, Shenzhen (CN); Junlong Liu, Shenzhen (CN)

(73) Assignee: Xiaojun Liu, Shenzhen (CN)

( * ) Notice: Subject to any disclaimer, the term of this patent is extended or adjusted under 35 U.S.C. 154(b) by 0 days.

(21) Appl. No.: 16/244,115

(22) Filed: Jan. 10, 2019

(30) Foreign Application Priority Data

Jul. 19, 2018 (CN) ..... 2018 1 0795097

(51) Int. Cl.

| | |
|---|---|
| ***F21V 23/00*** | (2015.01) |
| ***F21V 21/22*** | (2006.01) |
| ***F21V 23/04*** | (2006.01) |
| ***F21S 9/03*** | (2006.01) |
| ***F21V 21/30*** | (2006.01) |
| *F21Y 115/10* | (2016.01) |

(52) U.S. Cl.
CPC ..... *F21V 23/003* (2013.01); *F21S 9/03* (2013.01); *F21V 21/22* (2013.01); *F21V 21/30* (2013.01); *F21V 23/0464* (2013.01); *F21Y 2115/10* (2016.08)

(58) Field of Classification Search
CPC .... F21V 23/003; F21V 23/0464; F21V 21/30; F21V 21/22; F21Y 2115/10; F21S 9/03
See application file for complete search history.

(56) References Cited

FOREIGN PATENT DOCUMENTS

| | | | | |
|---|---|---|---|---|
| CN | 103791408 A | * | 5/2014 | |
| CN | 205782178 U | * | 12/2016 | ..... F21V 21/06 |
| CN | 106764899 A | * | 5/2017 | |
| CN | 107131475 A | * | 9/2017 | |
| CN | 107763479 A | * | 3/2018 | |

* cited by examiner

*Primary Examiner* — Anh T Mai
*Assistant Examiner* — Glenn D Zimmerman

(57) ABSTRACT

An LED lamp includes a main body and a lamp body assembly arranged on an upper portion of the main body. A automatic telescopic mechanism assembly connecting the main body and the lamp body assembly is arranged between the main body and the lamp body assembly to change a height of the lamp body assembly. A controller, a power supply, a data memory, a wireless communication transmission unit for communicating with an external mobile terminal, an alerter for generating an alarm sound in case of an emergency, a sound device, and a voltage stabilizer are arranged inside the main body. A touch display screen and a plurality of control buttons are arranged on a front surface of the main body. A radiator for a real time heat dissipation of the LED lamp is arranged inside the main body.

6 Claims, 3 Drawing Sheets

LED LAMP

BACKGROUND

1. Technical Field

The present disclosure relates to a field of light emitting diode (LED) lamp technology, and in particularly to a high luminous efficiency LED lamp with reasonable structural design and high environmental protection, and is convenient to use.

2. Description of Prior Art

Most conventional lighting lamps are powered by an external power supply. Such a conventional structural design requires a large amount of electric energy, which is costly and puts a large burden on users that use them. Further, the incandescent lamp is mostly used as a light bulb for the lighting lamps, but the incandescent lamp has disadvantages, such as poor luminous efficiency, high energy consumption, large heat, short service life, etc, which bring more troubles to the user and are not conducive to better promote and use products.

Base on above problems, a large amount of research, development and experiments have been carried out by those skilled in the art, and improvements have been made from various aspects such as the specific structure and function of the LED lamp, and good results have been obtained.

SUMMARY

In order to overcome the problems existing in the prior art, the present disclosure provides a high luminous efficiency light emitting diode (LED) lamp with reasonable structural design and high environmental protection, and is convenient to use.

Compared with the prior art, the present disclosure of an LED lamp comprises a main body and a lamp body assembly arranged on an upper portion of the main body. A automatic telescopic mechanism assembly is arranged between the main body and the lamp body assembly, the automatic telescopic mechanism assembly connects the main body and the lamp body assembly, and is configured to change a height of the lamp body assembly. A controller, a power supply, a data memory, a wireless communication transmission unit for communicating with an external mobile terminal, an alerter for generating an alarm sound in case of an emergency, a sound device, and a voltage stabilizer are arranged inside the main body. In actual use, the height of the lamp body assembly is flexibly changed by the automatic telescopic mechanism assembly, which is beneficial to adjust the appropriate height according to different environments, and has a high degree of intelligence. The LED lamp is reasonable in structure design and good in use effect.

DETAILED DESCRIPTION

To make the objects, technical proposals and merits of the present disclosure more apparent, the present disclosure will be further described in detail with reference to the drawings and embodiments. It should be understood that the embodiments described here are only used to illustrate the present disclosure and are not intended to limit the present disclosure.

Figure 1:
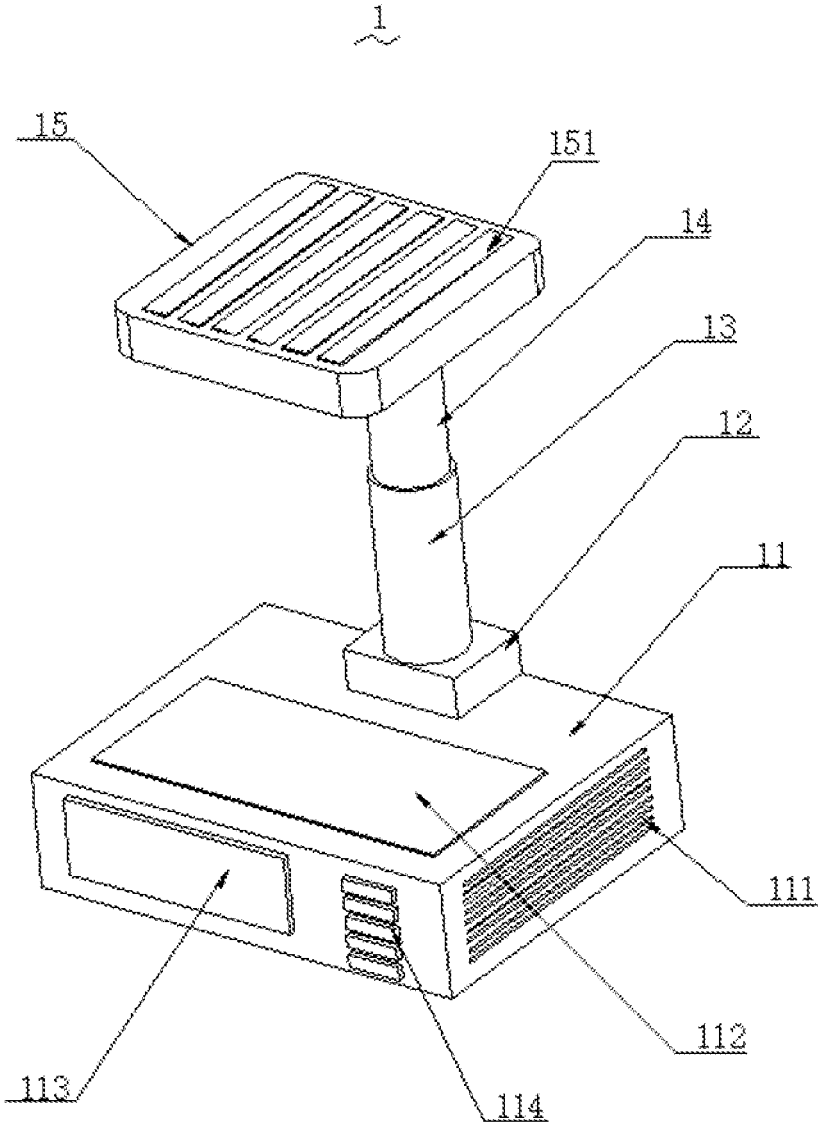
FIG. 1 is a perspective view showing a structure diagram of an LED lamp of the present disclosure.
Figure 2:
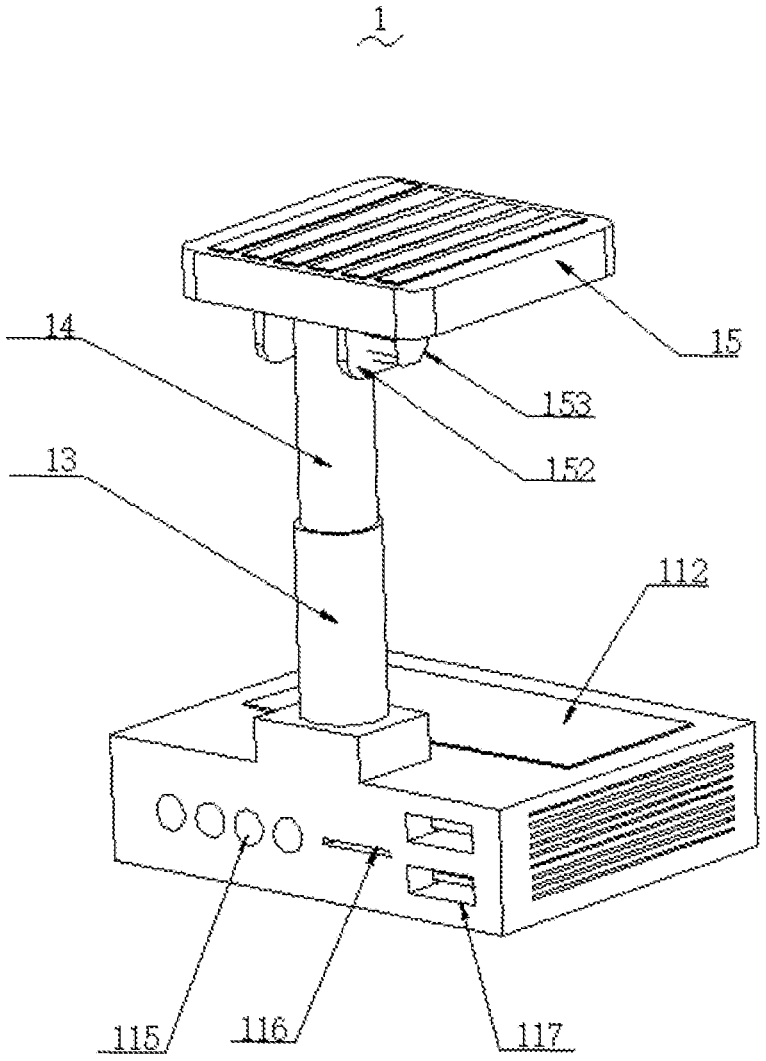
FIG. 2 is another perspective view showing a structure diagram of the LED lamp of the present disclosure.
Figure 3:
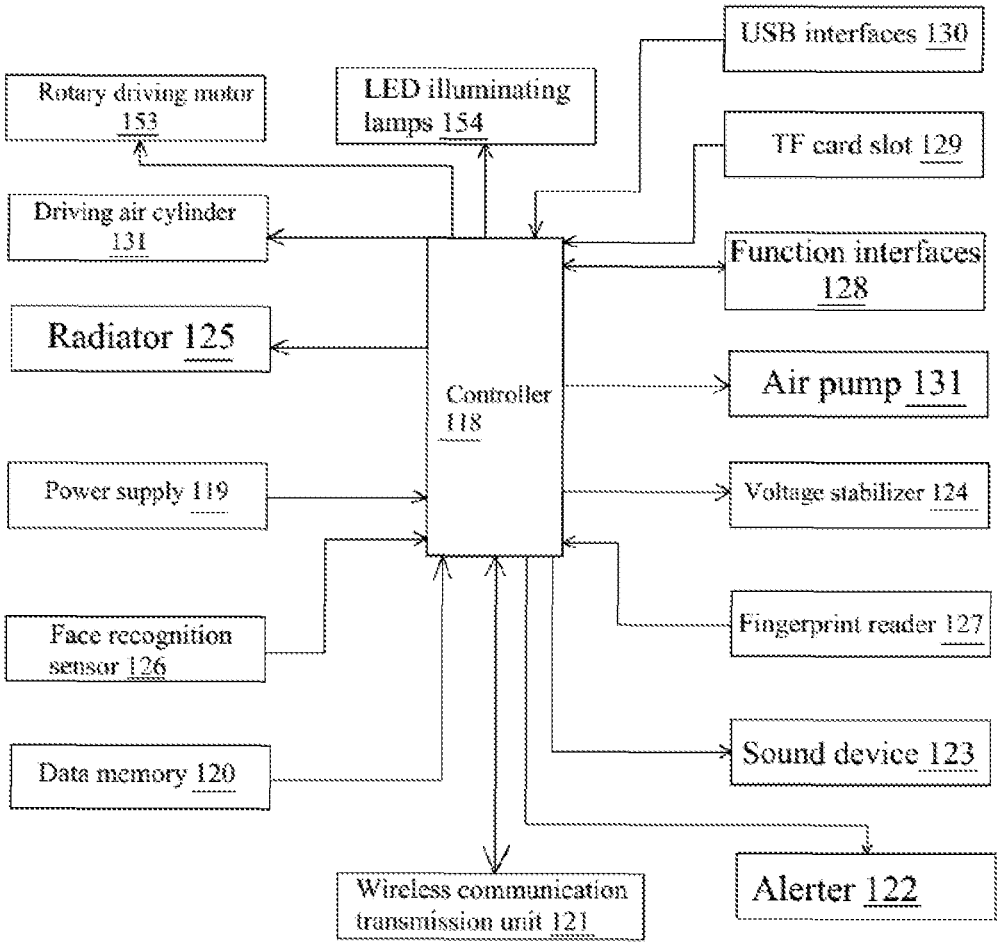
FIG. 3 is a structural diagram showing a circuit connection structure of the LED lamp of the present disclosure.

As shown in FIG. 1 to FIG. 3, the present disclosure of a light emitting diode (LED) lamp 1 includes a main body 11 and a lamp body assembly 15 arranged on an upper portion of the main body 11. An automatic telescopic mechanism assembly is arranged between the main body 11 and the lamp body assembly 15. The automatic telescopic mechanism assembly connects the main body 11 and the lamp body assembly 15, and is configured to change a height of the lamp body assembly 15. A controller 118, a power supply 119, a data memory 120, a wireless communication transmission unit 121 for communicating with an external mobile terminal, an alerter 122 for generating an alarm sound in case of an emergency, a sound device 123, and a voltage stabilizer 124 are arranged inside the main body 11. A touch display screen 113 and a plurality of control buttons 114 are arranged on a front surface of the main body 11. A radiator 125 for a real time heat dissipation of the LED lamp is arranged inside the main body 11. A touch plate 112 configured to receive the control information is arranged on the upper portion of the main body 11.

The automatic telescopic mechanism assembly comprises a base 12, a connecting rod 13 arranged on an upper portion of the base 12, and a telescopic rod 14 configured to connect the connecting rod 13 and the lamp body assembly 15. A driving air cylinder 131 configured to drive the telescopic rod 14 to move up and down is arranged inside the connecting rod 13. The lamp body assembly 15 further comprises a housing, a plurality of LED illuminating lamps 154 arranged on a lower portion of the housing, and a plurality of solar panels 151 arranged on an upper portion of the housing.

The lamp body assembly 15 is an integral square body. Two sides of the main body 11 defining vent holes, and the vent holes further improve a ventilation performance of the LED lamp 1. The data memory 120, the wireless communication transmission unit 121, the alerter 122, the sound device 123, the voltage stabilizer 124, the touch display screen 113, the control buttons 114, the radiator 125, the touch plate 112, the driving air cylinder 131, the LED illuminating lamps 154, the solar panels 151 are electrically connected with the controller 118.

A face recognition sensor 126 and a fingerprint reader 127 are arranged on the front surface of the main body 11. The face recognition sensor 126 is configured to perform face recognition and face sensing, and the fingerprint reader 127 is configured to control an operation of the LED lamp 1. A plurality of function interfaces 128, a trans flash (TF) card slot 129 and a plurality of universal serial bus (USB) interfaces 130 are arranged on a rear portion of the main body 11. The face recognition sensor 126, the fingerprint reader 127, the function interfaces 128, the TF card slot 129 and the USB interfaces 130 are electrically connected with the controller 118.

An angle adjusting mechanism assembly configured to flexibly and automatically adjust an irradiation angle of the lamp body assembly is arranged on a connection portion of the telescopic rod 14 and the lamp body assembly 15. The angle adjusting mechanism assembly comprises a rotating support member 152 and a rotary driving motor 153. The rotating support member 152 supports and connects with the lamp body assembly 15. The rotary driving motor 153 drives the lamp body assembly 15 to rotate relative to the telescopic rod 14. The rotating support member 152 is connected with the telescopic rod 14 by a rotary shaft. The rotary driving motor 153 is electrically connected with the controller 118.

The main body 11 ranges from 10-12 cm in length, the main body 11 ranges from 8-11 cm in width, and the main body 11 ranges from 3-5 cm in height. The vent holes arranged on the two sides of the main body 11 are parallelly arranged strip holes of equal intervals from top to bottom. Each strip hole ranges from 2-3 cm in width. The lamp body assembly 15 ranges from 8-12 cm in length, ranges from 6-8 cm in width, and ranges from 2-5 cm in height. A non-slip mat configured to prevent the LED lamp 1 from sliding is arranged on any of four diagonal positions arranged at a bottom portion of the main body 11. The automatic telescopic mechanism assembly is arranged at a rear portion of the main body, and the base 12 is a cube-shaped. The connecting rod 13 ranges from 3-5 cm in diameter. The solar panels 152 in the lamp body assembly 15 are arranged side by side at equal intervals, and a spacing between the solar panels ranges from 0.55-0.85 cm.

The present disclosure of the LED lamp 1 comprises the main body 11 and the lamp body assembly 15 arranged on the upper portion of the main body 11. The automatic telescopic mechanism assembly is arranged between the main body 11 and the lamp body assembly 15. The automatic telescopic mechanism assembly connects the main body 11 and the lamp body assembly 15 and is configured to change the height of the lamp body assembly 15. The controller 118, the power supply 119, the data memory 120, the wireless communication transmission unit 121 for communicating with the external mobile terminal, the alerter 122 for generating the alarm sound in case of the emergency, the sound device 123, and the voltage stabilizer 124 are arranged inside the main body 11. In actual use, the height of the lamp body assembly 15 is flexibly changed by the automatic telescopic mechanism assembly, which is beneficial to adjust the appropriate height according to different environments, and has a high degree of intelligence. The LED lamp is reasonable in structure design and good in use effect.

Furthermore, a rotating disc is arranged on an upper portion of the base 12 of the automatic telescopic mechanism assembly. And a micro-rotary motor is arranged in the rotating disc. The rotating disc is located between the connecting rod 13 and the base 12. The micro-rotary motor is electrically connected with the controller 118.

Furthermore, the wireless communication transmission unit 121 comprises a wireless BLUETOOTH unit, a 2.4G wireless communication unit, and a WIFI transmission unit.

Furthermore, the upper portion of the main body 11 defining an air blow hole, and an air pump 131 is arrange inside the main body. The air pump is connected with the air blow hole through a ventilation pipeline. The air pump 131 is electrically connected with the controller 118.

Furthermore, a light sensation sensor for real-time sensing of external light intensity is arranged on a front end portion of the lamp body assembly 15. The light sensation sensor is electrically connected with the controller 118.

Furthermore, the power supply 119 is a rechargeable lithium battery.

Compared with the prior art, the present disclosure of the LED lamp 1 comprises the main body 11 and the lamp body assembly 15 arranged on the upper portion of the main body 11. The automatic telescopic mechanism assembly is arranged between the main body 11 and the lamp body assembly 15. The automatic telescopic mechanism assembly connects the main body 11 and the lamp body assembly 15 and is configured to change the height of the lamp body assembly 15. The controller 118, the power supply 119, the data memory 120, the wireless communication transmission unit 121 for communicating with the external mobile terminal, the alerter 122 for generating the alarm sound in case of the emergency, the sound device 123, and the voltage stabilizer 124 are arranged inside the main body 11. In actual use, the height of the lamp body assembly 15 is flexibly changed by the automatic telescopic mechanism assembly, which is beneficial to adjust the appropriate height according to different environments, and has a high degree of intelligence. The LED lamp is reasonable in structure design and good in use effect.

The above-described embodiments of the present disclosure are not to be construed as limiting the scope of the present disclosure. Any of the modifications, equivalent replacement, and improvement within the spirit and principle of the present disclosure should fall within the protection scope of the claim.

What is claimed is:

1. A light emitting diode (LED) lamp, comprising:

a main body; and a lamp body assembly arranged on an upper portion of the main body;

wherein an automatic telescopic mechanism assembly is arranged between the main body and the lamp body assembly; the automatic telescopic mechanism assembly connects the main body and the lamp body assembly, and is configured to change a height of the lamp body assembly; a controller, a power supply, a data memory a wireless communication transmission unit for communicating with an external mobile terminal, an alerter for generating an alarm sound in case of an emergency, a sound device, and a voltage stabilizer are arranged inside the main body; a touch display screen and a plurality of control buttons are arranged on a front surface of the main body; a radiator for a real time heat dissipation of the LED lamp is arranged inside the main body; a touch plate configured to receive the control information is arranged on the upper portion of the main body;

wherein the automatic telescopic mechanism assembly comprises a base, a connecting rod arranged on an upper portion of the base, and a telescopic rod configured to connect the connecting rod and the lamp body assembly, a driving air cylinder configured to drive the telescopic rod to move up and down is arranged inside the connecting rod; the lamp body assembly further comprises a housing, a plurality of LED illuminating lamps arranged on a lower portion of the housing, and a plurality of solar panels arranged on an upper portion of the housing;

wherein the lamp body assembly is an square body; two sides of the main body defining vent holes, and the vent holes further improve a ventilation performance of the LED lamp; the data memory, the wireless communication transmission unit, the alerter, the sound device, the voltage stabilizer, the touch display screen, the control buttons, the radiator, the touch plate, the driving air cylinder, the LED illuminating lamps, the solar panels are electrically connected with the controller;

wherein a face recognition sensor and a fingerprint reader are arranged on the front surface of the main body, the face recognition sensor is configured to perform face recognition and face sensing; and the fingerprint reader is configured to control an operation of the LED lamp; a plurality of function interfaces, a trans flash (TF) card slot and a plurality of universal serial bus (USB) interfaces are arranged on a rear portion of the main body; the face recognition sensor, the fingerprint reader, the function interfaces, the TF card slot and the USB interfaces are electrically connected with the controller;

wherein an angle adjusting mechanism assembly configured to flexibly and automatically adjust an irradiation angle of the lamp body assembly is arranged on a connection portion of the telescopic rod and the lamp body assembly; the angle adjusting mechanism assembly comprises a rotating support member and a rotary driving motor; the rotating support member supports and connects with the lamp body assembly; the rotary driving motor drives the lamp body assembly to rotate relative to the telescopic rod; the rotating support member is connected with the telescopic rod by a rotary shaft; the rotary driving motor is electrically connected with the controller;

wherein the main body ranges from 10-12 cm in length, the main body ranges from 8-11 cm in width, and the main body ranges from 3-5 cm in height; the vent holes arranged on the two sides of the main body are parallelly arranged strip holes of equal intervals from top to bottom; each strip hole ranges from 2-3 cm in width; the lamp body assembly ranges from 8-12 cm in length, ranges from 6-8 cm in width, and ranges from 2-5 cm in height; a non-slip mat configured to prevent the LED lamp from sliding is arranged on any of four diagonal positions arranged at a bottom portion of the main body; the automatic telescopic mechanism assembly is arranged at a rear portion of the main body; and the base is a cube-shaped, the connecting rod ranges from 3-5 cm in diameter; the solar panels in the lamp body assembly are arranged side by side at equal intervals, and a spacing between the solar panels ranges from 0.55-0.85 cm.

2. The LED lamp according to claim 1, wherein a rotating disc is arranged on an upper portion of the base of the automatic telescopic mechanism assembly, and a micro-rotary motor is arranged in the rotating disc; the rotating disc is located between the connecting rod and the base; the micro-rotary motor is electrically connected with the controller.

3. The LED lamp according to claim 1, wherein the wireless communication transmission unit comprises a wireless BLUETOOTH unit, a 2.4G wireless communication unit, and a WIFI transmission unit.

4. The LED lamp according to claim 1, wherein the upper portion of the main body defining an air blow hole, and an air pump is arranged inside the main body, and the air pump is connected with the air blow hole through a ventilation pipeline; the air pump is electrically connected with the controller.

5. The LED lamp according to claim 1, wherein a light sensation sensor for real-time sensing of external light intensity is arranged on a front end portion of the lamp body assembly; the light sensation sensor is electrically connected with the controller.

6. The LED lamp according to claim 1, wherein the power supply is a rechargeable lithium battery.

* * * * *